US005743111A

United States Patent [19]

Sasaki et al.

[11] Patent Number: 5,743,111

[45] Date of Patent: Apr. 28, 1998

[54] AIR CONDITIONER SYSTEM HAVING A REFRIGERANT DISTRIBUTOR AND METHOD OF MAKING SAME

[75] Inventors: Shunji Sasaki, Shizuoka-ken; Atsuhiro Kobayashi, Shimizu; Hideki Okuzono, Shizuoka-ken; Futoshi Kawamura; Masahiro Ito, both of Shimizu; Hiroyasu Yoneyama, Shizuoka-ken; Kazuhisa Yagi, Yaidu, all of Japan

[73] Assignee: Hitachi, Ltd., Tokyo, Japan

[21] Appl. No.: 530,517

[22] Filed: Sep. 19, 1995

[30] Foreign Application Priority Data

Sep. 19, 1994 [JP] Japan ..... 6-222968

[51] Int. Cl.[6] ..... F25B 41/06

[52] U.S. Cl. ..... 62/511; 62/525; 62/527; 165/110; 165/150; 165/174

[58] Field of Search ..... 165/173, 174, 165/175, 110, 150; 62/511, 525, 527, 528

[56] References Cited

U.S. PATENT DOCUMENTS 4,093,024 6/1978 Middleton ..... 165/174 X 4,324,112 4/1982 Fujiwara et al. ..... 62/511

5,214,939 6/1993 Drucker et al. ..... 62/511 X

FOREIGN PATENT DOCUMENTS 4 281166 10/1992 Japan .

*Primary Examiner*—Harry B. Tanner

*Attorney, Agent, or Firm*—Evenson McKeown Edwards & Lenahan, PLLC

[57] ABSTRACT

A heat exchanger, as mounted on the outdoor unit or indoor unit of an air conditioner system, is formed with a plurality of passages for a refrigerant. To this heat exchanger, there is connected a refrigerant distributor for distributing the refrigerant to the individual passages or for collecting the distributed refrigerant. This refrigerant distributor is constructed by soldering two corrugated plate members to form a refrigerant conduit between the corrugations. Before these plate members are soldered, the refrigerant conduit is either partially constricted to form a throttle portion or partially bulged to form a filter portion by fitting a filter member in the bulging portion when the plate members are soldered. Thus, the refrigerant distributor can set the diversion of the refrigerant to a predetermined ratio by the simple device while reducing the space and lowering the cost.

29 Claims, 7 Drawing Sheets

AIR CONDITIONER SYSTEM HAVING A REFRIGERANT DISTRIBUTOR AND METHOD OF MAKING SAME

BACKGROUND AND SUMMARY OF THE INVENTION

The present invention relates to an air conditioner and, more particularly, to an outdoor unit and/or an indoor unit of an air conditioner equipped with a heat exchanger having a plurality of refrigerant passages, and a refrigerant distributor system for use in same.

In heat exchangers having a plurality of refrigerant passages, a distributor or a header is used in the prior art to distribute the refrigerant at predetermined ratios to the individual refrigerant passages.

These prior art arrangements using a distributor are required to have a diversion device for diverting the refrigerant and a diversion pipe for introducing the individual refrigerant flows from the diverting device to a refrigerant heat exchanger. In order to smooth the refrigerant flows when the diverting device and the diversion pipe are connected to the heat exchanger, moreover, a mounting space for the diverting device and diversion pipe is enlarged to prevent channeling which might otherwise be caused by the flow resistance to the refrigerant. Hence, the construction of these prior art arrangements is complicated.

The use of a header in such systems is advantageous in reducing the costs for the refrigerant distributor. However, channeling is liable to occur in each of the distributed refrigerant flows so that the refrigerant is difficult to distribute equally or in a necessary flow rate to the individual refrigerant passages of the heat exchanger.

In order to eliminate the aforementioned drawback of the prior art, there has been proposed a heat exchanger system which uses plate piping, as disclosed in Japanese Unexamined Patent publication 4-281166 (1992). In this prior art heat exchanger system, the flow rate of refrigerant is uniformly distributed to the individual refrigerant passages of the heat exchanger with the plate piping distributor having uniform cross section passages for the refrigerant supplied to the respective heat exchanger passages. In this prior art sufficient consideration has not been taken of the fact that the refrigerant flow rate to be distributed should be varied for the individual passages as the heat exchanging capacities of the individual passages of the heat exchanger are varied. The prior art arrangements also do not consider the case in which refrigerant inlet portions of individual small heat exchangers cannot be arrayed in a plane when the heat exchanger system is constructed of such small heat exchangers. The prior art arrangements also do not sufficiently consider the prevention of the heat transfer of the refrigerant from the inlet to the outlet of the heat exchanger or vice versa.

An improved heat exchanger is therefore needed of the type having plural flow conduits used for an air conditioner, with feeding of a refrigerant at predetermined different flow rates to the different individual refrigerant conduits of the heat exchanger. More particularly, an improved heat exchanger system with these features and utilizing a plate piping for the refrigerant distributor is needed for use with heat exchangers in the outdoor unit and/or indoor unit of the air conditioner system.

There is also needed an improved air conditioner system with a simplified construction of the air conditioner system having a reduction in the required mounting space and in the manufacturing costs.

An improved air conditioner system is also needed to cope with complex arrangements of the heat exchanger units and to prevent the heat transfer from the inlet to the outlet of the heat exchanger via the refrigerant distributor or vice versa.

Various of these and other needs are met by preferred embodiments of the invention by providing an air conditioner system arrangement which includes a heat exchanger with plural separate heat exchanger refrigerant conduits and a refrigerant distributor disposed upstream of the heat exchanger and formed by joining a pair of corrugated plate members to form distributor refrigerant conduits along facing corrugation grooves of the plate members for communicating refrigerant to the respective heat exchanger refrigerant conduits, wherein said at least one of the distributor refrigerant conduits includes a control portion preformed at the grooves of the plate members for controlling a flow rate of the refrigerant flowing therethrough.

In certain preferred embodiments of the invention the control portion in the distributor formed of the pair of corrugated plate members are in the form of predetermined constricted sections of the distributor refrigerant conduits. Advantageously, these constricted sections can be economically and reliably formed during stamping out or pressing of the plate shaped members. In especially preferred embodiments, the grooves in the two plate members have a semicircular cross section along substantially their entire length, such that maximum refrigerant pressure resistance is provided when the plate members are joined by soldering or welding with consequent formation of circular cross section conduits.

In certain preferred embodiments, the distributor refrigerant conduits formed by facing grooves of the plate members include at least one bulged section of greater cross-sectional size than adjacent conduits sections, and wherein a filter or other flow control member is disposed inside said bulged section, separate from and movable with respect to the plate members, so that when the plate members are soldered or welded together, the filter or other flow control member is reliably held in position in the conduits section formed by the bulged sections.

In certain preferred embodiments of the present invention, the distributor is formed by joining two essentially flat planar plate members which extend in a plane parallel to a heat exchanger unit adjacent one end of the heat exchanger. These distributor and heat exchange combinations of planar distributor plate members are advantageous in providing a thin flat exchanger/distributor arrangement.

In certain preferred embodiments of the present invention, the distributor is formed by joining two L-shaped plate members. The grooves in the plates forming the refrigerant conduits are preferably all disposed in one leg of the L-shaped plates, while the other leg of the L-shaped plates are provided with means, such as mounting holes for bolt connections or the like, to facilitate attachment of the distributor to adjacent fixed structure such as a cabinet of the air conditioner. Thus, in a simple to construct arrangement, a heat exchanger/distributor arrangement of compact construction can be adapted to practical building constructions.

In certain preferred embodiments of the invention, the distributor is formed by joining two U-shaped plate members. Advantageously, the legs of the U-shape are utilized to form refrigerant conduits for plural sets of refrigerant passages in a heat exchanger unit and extend parallel to side walls of the heat exchanger unit. The bottom of the U-shape extends transversely of the two sets of heat exchanger unit conduits and serves to rigidify the heat exchanger distributor assembly in a reliable compact and economical manner.

Preferred embodiments of outdoor units of an air conditioner, include an outdoor heat exchanger having a plurality of refrigerant conduits, an outdoor fan to supply air to said outdoor heat exchanger, and a refrigerant distributor prepared by joining a pair of corrugated plate members, the distributor being connected to the outdoor heat exchanger for distributing the refrigerant to the conduits respectively, wherein at least one of distributor refrigerant conduits includes a control portion for controlling a flow rate at one of outdoor heat exchanger conduits.

Preferred embodiments of indoor units of an air conditioner include an indoor heat exchanger including a plurality of conduits for refrigerant exchanging heat between indoor air and refrigerant, an indoor fan for supplying conditioned air to a room, and a refrigerant distributor prepared by joining a pair of plate members, the distributor being connected to the indoor heat exchanger for distributing the refrigerant to the conduits respectively, wherein at least one of distributor refrigerant conduits includes a control portion for controlling a flow rate through one of indoor heat exchanger conduits distributor for controlling a flow rate at one of indoor heat exchanger conduits.

The present invention also contemplates preferred embodiments of an air conditioner system which include an outdoor unit disposed outdoors and having an outdoor heat exchanger and an outdoor fan, and at least one indoor unit connected to the outdoor unit forming a refrigerating cycle with the outdoor unit. The indoor unit has an indoor heat exchanger and an indoor fan. At least one heat exchanger of the outdoor unit and at least one indoor unit further comprises a plurality of conduits for refrigerant, a refrigerant distributor prepared by joining a pair of corrugated plate members having a plurality of grooves formed thereon and connected with the plurality of conduits, wherein at least one conduit provides a control portion for controlling a flow rate at the conduit.

It is a further advantage of certain preferred embodiments of the present invention that since the corrugated flow passages prepared before welding in both plate members are paired and opposite each other, the plate members may not be destroyed or deformed by the fluid pressure within flow passages.

It is a further advantage of preferred embodiments of the present invention that since there may be flow direction switching members or filters in the flow distributor, namely, several elements of the refrigerating cycle are contained in the flow distributor, so that a multi-room or single room air conditioner can be made simple.

It is further an advantage of certain preferred embodiments of the present invention that the plate members are folded as figures "L" or "U", so that it is possible to accommodate the distributor to adjacent fixed structure, and the freedom of disposing the heat exchangers in the air conditioner equipment can be expanded and the air conditioner can be more simplified. In especially preferred embodiments, the plate members have at least one aperture between inlet portion connected to the inlet of the heat exchanger and outlet portion connected to the outlet of the heat exchanger, so that it is possible to keep the heat from transferring between inlet and outlet of the heat exchanger.

Other objects, advantages and novel features of the present invention will become apparent from the following detailed description of the invention when considered in conjunction with the accompanying drawings.

DESCRIPTION OF THE PREFERRED EMBODIMENTS

Figure 1:
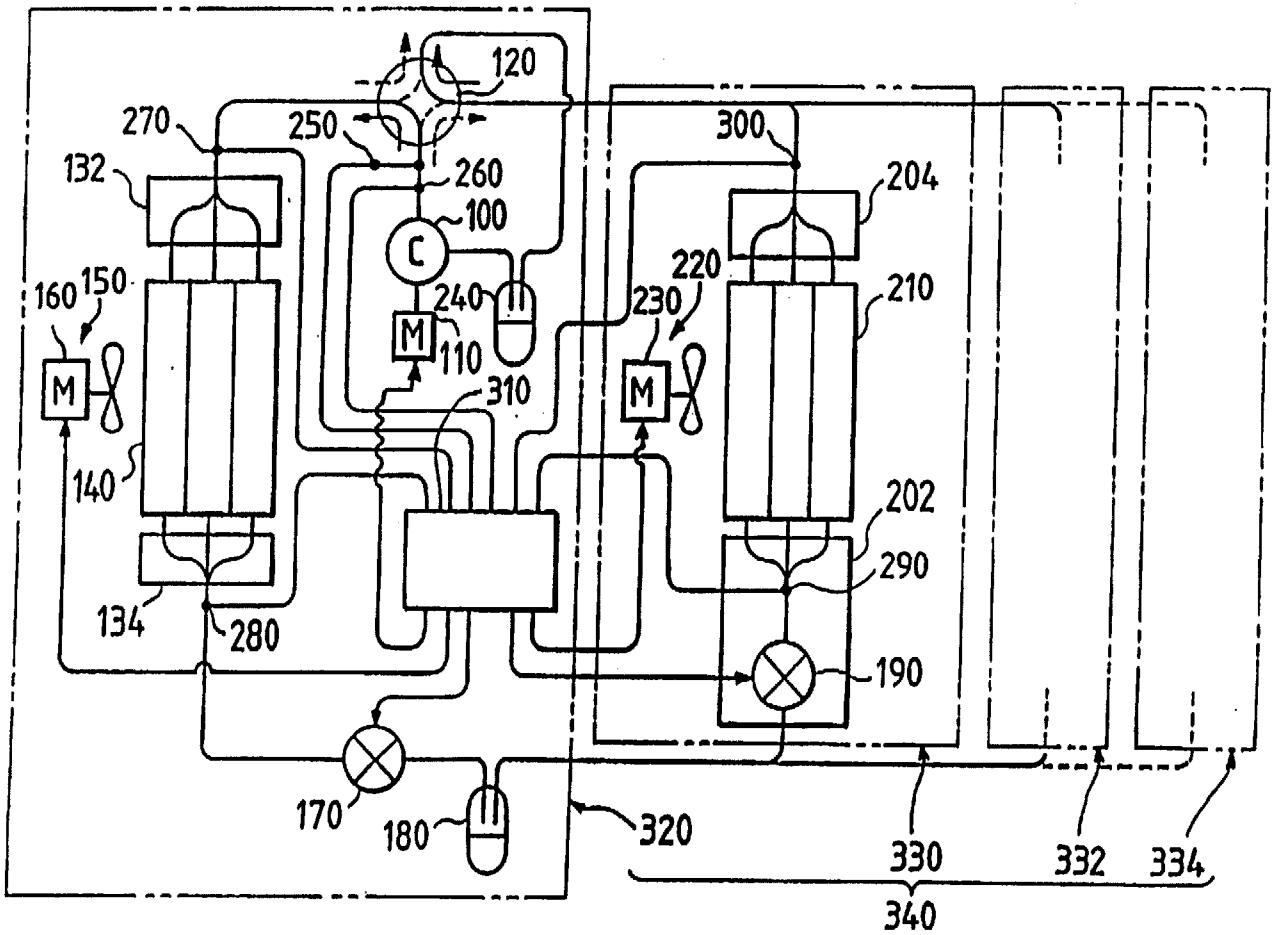
FIG. 1 is a schematic diagram showing a multi-room air conditioner according to an embodiment of the present invention.

FIG. 1 schematically shows a multi-room air conditioner system according to the present invention. The multi-room air conditioner system 340 is constructed by piping one outdoor unit 320 to a plurality of indoor units 330, 332 and 334. The outdoor unit 320 is equipped with a compressor 100, an outdoor heat exchanger 140, an outdoor expansion valve 170 and so on, whereas each of the indoor units 330–334 is equipped with an indoor heat exchanger 210 and so on.

In this multi-room air conditioner, refrigerant flows through the following passages. Specifically, in the cooling mode, the gas refrigerant is discharged at a high temperature and under a high pressure from the compressor 100 and flows through a four-way valve 120 into the outdoor heat exchanger 140 having a plurality of conduits. In order to distribute the refrigerant into a plurality of conduits at this time, the outdoor heat exchanger is equipped with an outdoor refrigerant distributor 132. The refrigerant condenses by exchanging its heat with the outdoor air, when it flows through the individual conduits in the outdoor heat exchanger 140. The refrigerant passing through an outdoor header 134 for collecting the refrigerant is liquified by the outdoor expansion mechanism, as exemplified by the outdoor expansion valve 170. Here in the vicinity of the outdoor heat exchanger 140, there is an outdoor fan 150 that is driven by a motor 160 to promote the heat exchange of the refrigerant. The refrigerant thus having flown out of the outdoor expansion valve 170 flows through a liquid receiver 180 into the indoor units 330–334. The refrigerant is adjusted at first to desired heat exchange ratios for the individual rooms by an indoor expansion mechanism 190 until it flows through the refrigerant distributor into the indoor heat exchanger 210 having a plurality of conduits.

Further, in FIG. 1, the refrigerant distributor and the indoor expansion mechanism are unified into an indoor distributor 202. The refrigerant having flown through the individual conduits of the indoor heat exchanger 210 is collected by an indoor header 204 and then flows through the four-way valve 120 and an accumulator 240 into the compressor 100. Then, the refrigerant circulates through this flow route. In the vicinity of the indoor heat exchanger 210, there is a fan 220 that is driven by a motor 230 to promote the heat exchange with the indoor air.

In the warming mode, the four-way valve has its way switched in the direction, as indicated by broken arrows, so that the refrigerant circulates in the direction reversed from that of the cooling mode. In this case, the reverse actions are performed by the outdoor refrigerant distributor 132, the outdoor header 134, the indoor refrigerant distributor 202 and the indoor header 204, which are connected to the outdoor heat exchanger 140 and the indoor heat exchanger 210.

The compressor 100 is equipped at its outlet with a sensor 260 for detecting the temperature and pressure of the refrigerant discharged from the compressor 100, and a sensor 250 for detecting the degree of super-heat. The outdoor heat exchanger 140 is equipped with sensors 270, 280 for sensing an inlet and outlet temperature or pressure, whereas the indoor heat exchanger 210 is equipped with sensors 290, 390 for sensing an inlet and outlet temperature or pressure. The outputs of these various sensors are input to a controller 310 to control the speed of a compressor motor 110, the individual throttling degrees of the outdoor expansion mechanism 170 and the indoor expansion mechanism 190, the speeds of the outdoor fan 150 and the indoor fan 220, and the flow rates of the air of the indoor units.

The details of the indoor units 332 and 334 are omitted from FIG. 1, but are given a construction similar to that of the indoor unit 330. Moreover, three indoor units are provided in FIG. 1, but may be any if they are more than one. The detail of the refrigerant distributor or header to be used in the air conditioner thus constructed according to the present invention will be described with reference to FIG. 2 and so on.

Figure 2:
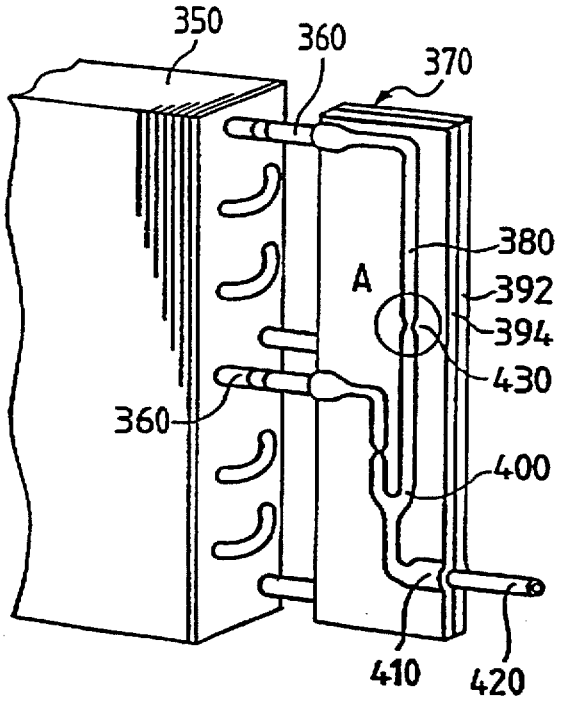
FIG. 2 is a perspective view of the embodiment of the present invention and shows the state in which a refrigerant distributor is attached to an outdoor heat exchanger or an indoor heat exchanger.
Figure 3:
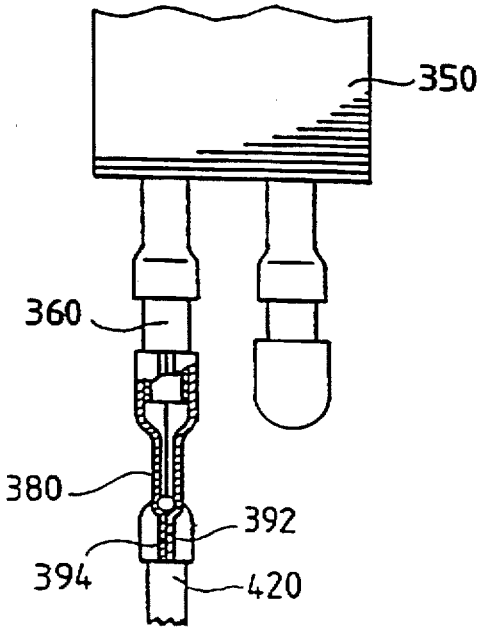
FIG. 3 is a top plan view showing portion A of FIG. 2 partially in section.

FIGS. 2 and 3 show one embodiment of the refrigerant distributor to be connected to the heat exchanger 140 or 210 which is mounted on the outdoor unit 320 or each of the indoor units 330–334 of the air conditioner 340. A cross-fin type heat exchanger 350 to be frequently used in the outdoor heat exchanger 140 of the air conditioner is equipped with a plurality of refrigerant conduits 360. A typical outdoor heat exchanger has seven refrigerant conduits. The width of the outdoor heat exchanger is 34.6 mm, the height is 840 mm, and the elongated length is 735 mm. On the other hand, a typical indoor heat exchanger has seven refrigerant conduits, and the width of the indoor heat exchanger is 34.6 mm, the height is 200 mm, and the elongated length is 1775 mm. A refrigerant distributor 370 is so designed that the refrigerant may be properly distributed to the individual conduits 360.

The refrigerant distributor 370 is constructed by soldering a pair of originally flat plate members 392 and 394 of the thickness 1.5 mm. When the plate members are made of copper or its alloy, they are soldered in a nitrogen atmosphere of 750° C. under pressure of about 2 kgf/cm$^2$. If the plate members are made of stainless steel, they are soldered in a vacuum of 1000° C. These plate members 392, 394 are internally corrugated to form conduits by a press machine. The conduits have substantially circular cross section of an inner diameter about 3 mils.

The refrigerant distributor 370 is formed with the inlet portions of the refrigerant conduits 360, a diversion pipe portion 380 connected to the inlet portion, a diversion adjustor 430 disposed midway of the diversion pipe portion 380, a diversion portion 400 for diverting the refrigerant to the diversion pipe portion 380, and an inlet pipe portion 410 for introducing the refrigerant into the diverting portion 400. To this inlet pipe portion 410, there is connected a refrigerant pipe 420 for introducing the refrigerant to the outside from the outdoor unit 320 or one of the indoor units 330–334. The corrugations may be formed in the corresponding portions of the individual plate members 392 and 394. In other words, if cross sections of the corrugations are symmetric in both plate members after the soldering step, the conduits can be less broken by the pressure of the refrigerant (maximum 30 kgf/cm$^2$) flowing through them. The pressure resistance to the refrigerant is improved the better as the sections of the corrugations are the closer to circles.

Figure 4:
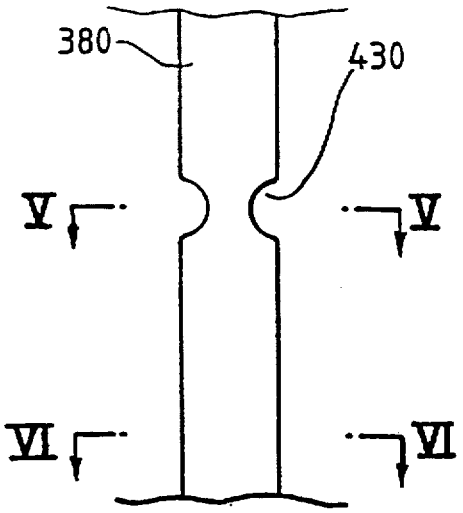
FIG. 4 is an explanatory view showing portion A of FIG. 2 in detail.
Figure 5:
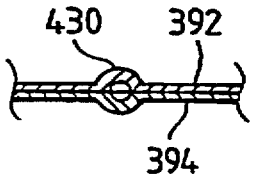
FIG. 5 is a section taken along line B—B of FIG. 4.
Figure 6:
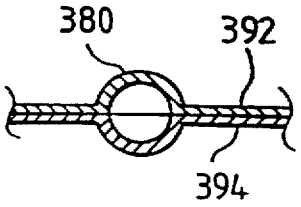
FIG. 6 is a section taken along line C—C of FIG. 4.

The distributions of the refrigerant to the individual refrigerant conduits 360 of the heat exchanger 350 are predetermined to optimum values according to those of the wind to blow against the heat exchanger 350. In order to achieve the predetermined distributions, the throttling degree of the diversion adjustor 430 having a throttle portion is determined, as will be detailed with reference to FIGS. 4–6.

The conduit is constricted to a smaller section than that of each diversion pipe 380 so that the flow rate of the diversion pipe 380 may be set to a proper value according to the sectional ratio. Then, the ability of the heat exchanger 350 can be maximized. Since the refrigerant distributor is constructed of only the two plate members without any addition of spare parts, the two plates can be easily joined. Moreover, since the refrigerant distributor can have its structure simplified, it reduces the space and lowers the cost. This throttling shape is desirably made spherical for the pressure resistance. Further, at least one flow controlling portion in the distributor can improve the flow distribution.

Figure 7:
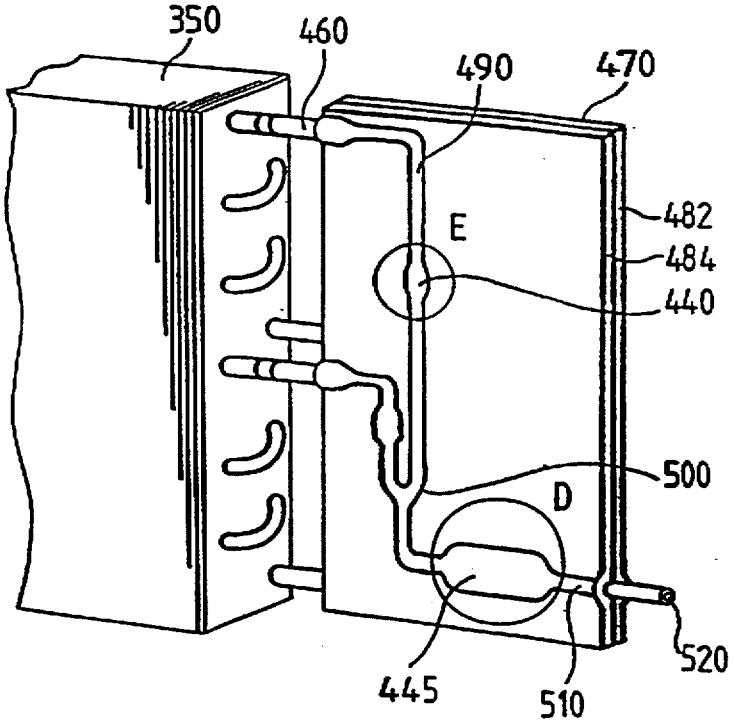
FIG. 7 is a perspective view showing another embodiment of the present invention.

FIG. 7 shows another embodiment of the present invention. As in the embodiment shown in FIG. 2, the cross-fin type heat exchanger 350 is constructed by folding the refrigerant pipes and by attaching a number of thin fins generally perpendicularly to the pipes. The heat exchanger 350 is formed with a plurality of refrigerant conduits 460 by using a plurality of pipes. A refrigerant distributor 470 is so designed that the refrigerant may be distributed at proper rates to the individual conduits 460. This refrigerant distributor 470 is constructed by soldering a pair of plate members 482 and 484 having a length of about 230 mm and a height of about 200 mm. These plate members 482, 484 are corrugated by a press machine to form the conduits. The refrigerant distributor 470 is formed with the inlet portions of the refrigerant passages 460, a throttling piece accommodating portion 440 disposed midway of the diversion pipe portion 490, a diverting portion 500 for diverting the refrigerant to the diversion pipe portion 490, and an inlet pipe portion 510 leading from a strainer accommodating portion 445 for introducing the refrigerant into the diverting portion 500. To this inlet pipe portion 510, there is connected a refrigerant pipe 520 having an inner diameter of 6.4 mm and an outer diameter of 7 mm for introducing the refrigerant to the outside from the outdoor unit or the indoor unit. In short, the present embodiment is different from that of FIG. 2 in that the refrigerant conduit between the plate members 482, 484 is formed in its midway with bulging portions D and E in which are fitted other members.

Figure 8:
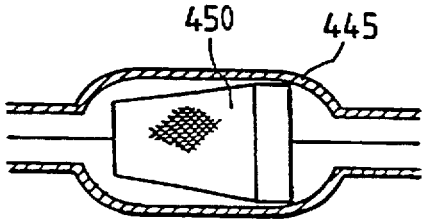
FIG. 8 is a longitudinal section of portion D of FIG. 7.
Figure 9:
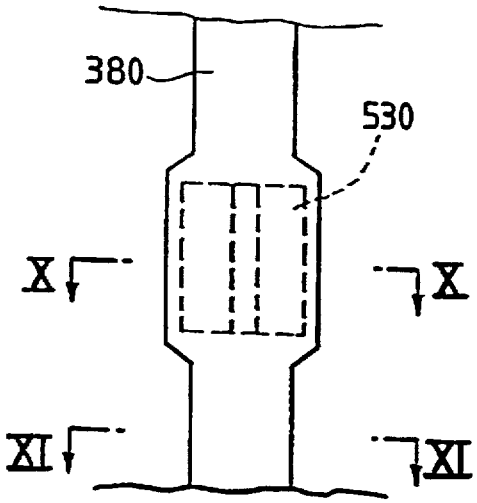
FIG. 9 is a detailed diagram showing portion E of FIG. 7.
Figure 10:
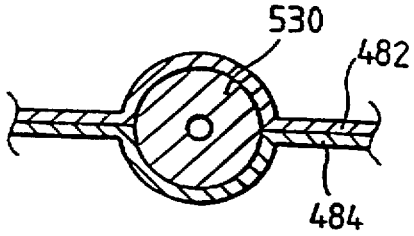
FIG. 10 is a section taken along line F—F of FIG. 9.
Figure 11:
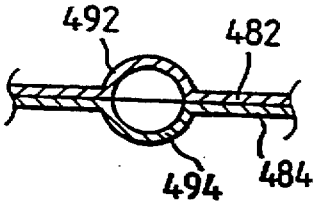
FIG. 11 is a section taken along line G—G of FIG. 9.

FIG. 8 shows an example of the member to be fitted in the bulging portion D, in which is fitted a strainer 450 for removing the dust. FIG. 9 shows an example of the member to be fitted in the portion E. FIG. 10 is a section taken along line G—G of FIG. 9. A throttling piece 530 is fitted in the bulging portion E of FIG. 9. This bulging portion E is enabled to perform an action similar to that of the diversion adjustor 430 of the embodiment shown in FIG. 2 by fitting the throttling piece 530.

According to the present embodiment, since the parts for the refrigerating cycle can be made integral and the number of parts can be reduced, it reduces the space and lowers the cost. Further, what is required in the present embodiment is to fit the strainer and the throttling piece in the bulging portions. Thus, these parts are sufficient if they can resist the soldering temperature of the plate members so that they exert no influence upon the soldering of the plate members. As a result, no disadvantage is present at the soldering so that the plate members can be soldered easily and highly accurately. In order to facilitate the soldering, it is desired that the parts can be loosely held in the bulging portions.

Figure 12:
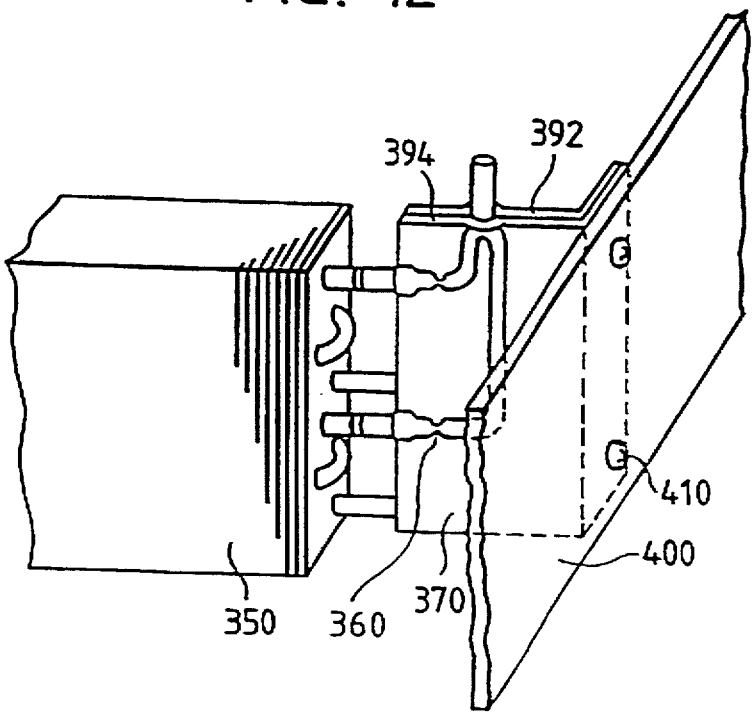
FIGS. 12 and 13 are perspective views showing still another embodiments of the present invention.

FIG. 12 shows still another embodiment of the present invention. In this embodiment, the refrigerant distributor 370 constructed of the two plate members 392 and 394 is formed with the refrigerant conduits 360 generally having a shape of letter "L" while leaving both the end portion to be connected to the heat exchanger 350 and the opposite end in the blank. By folding these ends and by forming holes or screw holes 410, the refrigerant distributor 370 can be mounted in the cabinet 400 or the like and fixed in the unit if its arrangement is restricted as in the indoor unit of the air conditioner. If the heat exchanger is so mounted in the ceiling built-in type indoor unit as to enclose the fan, the refrigerant distributor can be used as a partition of the air, which may leak in the prior art from the ends of the heat exchanger.

The refrigerant distributor of the aforementioned embodiments is desirably made of copper or its alloy, or an iron alloy so that it may be conveniently connected to the heat exchanger. If the facility of soldering is considered, the most preferable material is phosphor bronze. Further, aluminum or its alloy can be used if the pressure level is low. In a modification of the present invention, a four-way valve can be disposed midway of the conduit. In this modification, the valve member of the four-way valve may be made of a ferromagnetic material so that it may be controlled to switch a flow direction of the refrigerant by an external magnetic field (not shown) disposed outside of the plate members. Moreover, the flow direction of the refrigerant may also be switched by using fluid control device. In addition, the electronic expansion valve may be replaced by pluralities of fluid conduits having on/off valves so that one of the conduits corresponding to the flow rate can be used with switching the valves. The plate members may be holed in their flat portions so as to isolate thermally the inlet side and outlet side of the heat exchanger.

Figure 13:
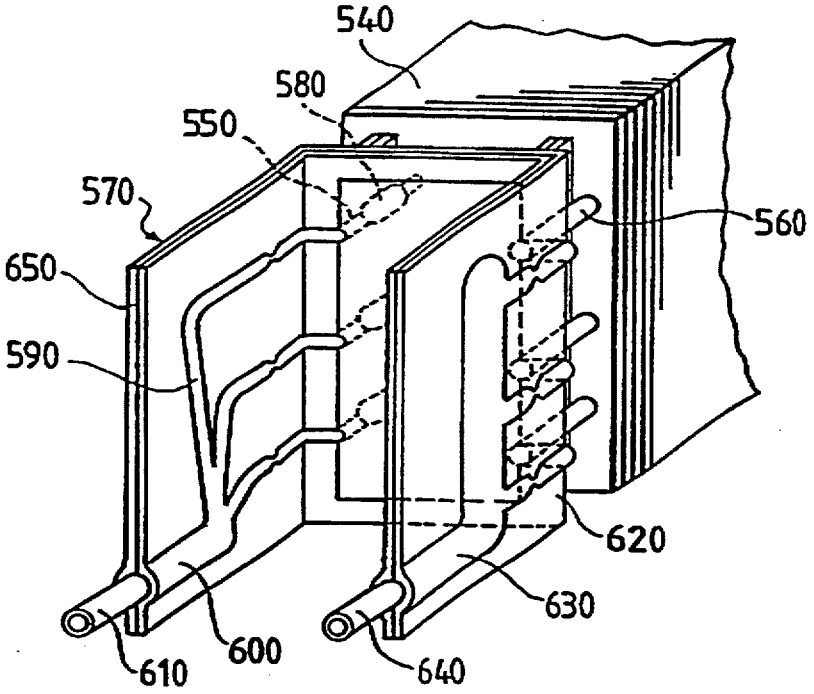
Figure 14:
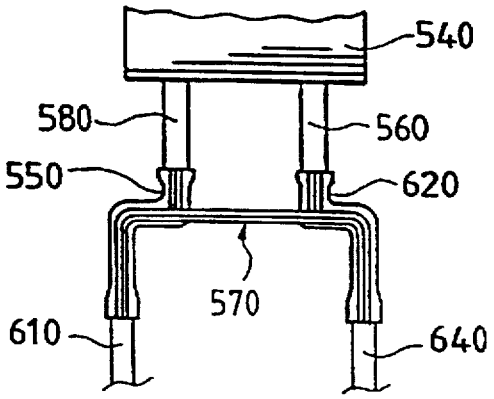
FIG. 14 is a top plan view of the embodiment shown in FIG. 13.

The modification thus made is shown in FIGS. 13 and 14. A heat exchanger 540 to be used in the outdoor unit or indoor unit of the air conditioner is of the cross-fin or fin-tube type and is formed at its one end with refrigerant inlet pipes 580 and discharge pipes 560. In the present embodiment, the heat exchanger 540 has three passages so that the inlet pipes 580 and the discharge pipes 560 are three in number. Each inlet pipe 580 and each discharge pipe 560 are respectively connected to the inlet side 550 and the discharge side 630 of a refrigerant distributor 570 which is prepared by corrugating two plate members 650 by a press and by soldering the corrugated plated members. Here, the inlet pipe 600 and the discharge pipe 630 of the refrigerant distributor 570 are respectively branched into three diverting pipes 590 and 620 according to the corresponding heat exchanger 540. The plate members at the inlet side and the discharge side are individually prepared by folding them in a hollowing manner to form frame-shaped holes. As a result, the heat transfer due to the temperature difference between the inlet side and the discharge side can be reduced by reducing the portions of heat transfer. The refrigerant distributor 570 has its inlet pipe 600 connected to a pipe 610 and its discharge pipe 630 connected to a pipe 640 thereby to establish the refrigerating cycle.

Figure 15:
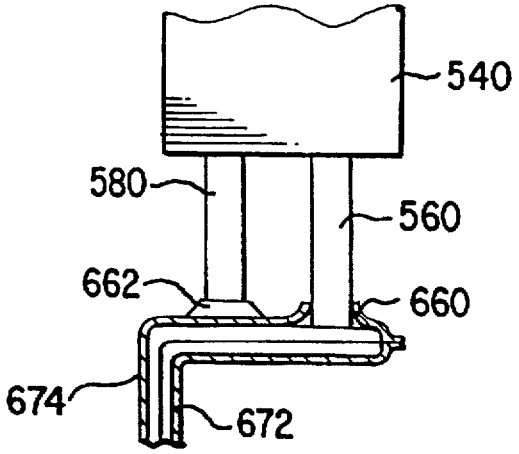
FIG. 15 is a top plan view of still another embodiment of the present invention.

FIG. 15 shows still another embodiment of the present invention. In this embodiment like the embodiment shown in FIG. 12, the refrigerant distributor constructed of the two plate members 672, 674 is formed with the refrigerant conduits generally having a shape of letter "L", and flow passages of refrigerant are formed in both ends. The conduits have an inlet portion 660 and discharge portion 662 in the side of the plate member 674. The cross-fin type heat exchanger 540 has a plurality of conduits. Each inlet 560 of the conduits of the heat exchanger 540 is connected to the inlet portion 660 of the distributor and each discharge 580 of the conduits of the heat exchanger is connected to the discharge 662 portion of the conduits of the heat exchanger 540. In this case, the distributor can be made more compact.

In any of the foregoing embodiments, the heat exchanger is exemplified by the single heat exchanger having a plurality of passages. Despite of this disclosure, however, the present invention can naturally be applied to a plurality of heat exchangers having a single passage, or a combination of a single heat exchanger having a plurality of passages and a plurality of heat exchangers having a single passage.

According to the present invention, in the outdoor unit or indoor unit of the air conditioner or in the refrigerant distributor mounted on the former, the refrigerant distributor can be distributed the refrigerant at proper rates to a plurality of refrigerant conduits belonging to the heat exchanger thereby to maximize the ability of the heat exchanger. Moreover, the refrigerant distributor can be simply constructed to reduce the space and lower the cost. The parts constructing the refrigerating cycle can be made integrated in the refrigerant distributor thereby to reduce the size of the unit and lower the cost. Still moreover, even if the heat exchanger has many refrigerant passages and a complicated inlet arrangement of passages, the refrigerant distributor is formed in the L-shape so that it can cope with any structure of the heat exchanger to be connected.

Although the invention has been described and illustrated in detail, it is to be clearly understood that the same is by way of illustration and example, and is not to be taken by way of limitation. The spirit and scope of the present invention are to be limited only by the terms of the append claims.

What is claimed is:

1. An air conditioner system having a refrigerant distributor comprising:

at least one heat exchanger including a plurality of conduits for refrigerant; and a refrigerant distributor disposed upstream of said heat exchanger and made by joining a pair of corrugated plate members to form distributor refrigerant conduits along facing corrugation grooves of the plate members for communicating refrigerant to the respective heat exchanger refrigerant conduits;

wherein at least one of said distributor refrigerant conduits includes a control portion preformed at the grooves of the plate members for controlling a flow rate of the refrigerant flowing therethrough.

2. An air conditioner system having a refrigerant distributor according to claim 1, wherein said at least one heat exchanger includes an outdoor heat exchanger, and further comprising an outdoor fan for supplying air to said outdoor heat exchanger.

3. An air conditioner system having a refrigerant distributor according to claim 1;

wherein said at least one heat exchanger includes an indoor heat exchanger, and further comprising an indoor fan for supplying air to said indoor heat exchanger.

4. An air conditioner system according to claim 2, wherein said at least one heat exchanger includes an indoor heat exchanger, and further comprising an indoor fan for supplying air to said indoor heat exchanger.

5. An air conditioner system having a refrigerant distributor according to claim 1, wherein said plurality of grooves are formed having a substantially semicircular cross section along substantially their entire length.

6. An air conditioner system having a refrigerant distributor according to claim 1, wherein said control portion is in the form of a predetermined constricted section of the distributor refrigerant conduit.

7. An air conditioner system having a refrigerant distributor according to claim 6, wherein the constricted section has a substantially circular cross section.

8. An air conditioner system having a refrigerant distributor according to claim 1, wherein said control portion is a bulged section of greater cross-sectional size than adjacent conduit sections and includes a control member disposed therein.

9. An air conditioner system having a refrigerant distributor according to claim 8, wherein said control member is separate from the plate members and movable in the bulged portion.

10. An air conditioner system having a refrigerant distributor according to claim 9, wherein said control member is at least one of a filter and a hollow cylinder.

11. A refrigerant distributor for distributing refrigerant to an air conditioner heat exchanger of the type having a plurality of separate heat exchanger refrigerant conduits, said refrigerant distributor comprising a pair of corrugated plate members joined to form a plurality of distributor refrigerant conduits along facing corrugation grooves of the plate members for communicating refrigerant to the respective heat exchanger refrigerant conduits, wherein at least one of said distributor refrigerant conduits includes a control portion preformed at the groove of the plate members for controlling a flow rate therethrough.

12. A refrigerant distributor according to claim 11;

wherein said control portion is in the form of a predetermined constricted section of the distributor refrigerant conduit.

13. A refrigerant distributor according to claim 11, wherein the grooves in the two plate members have a substantially semicircular cross section along substantially their entire length.

14. A refrigerant distributor according to claim 11, wherein said pair of corrugated plate members are L-shaped plate members.

15. A refrigerant distributor according to claim 14, wherein the grooves are formed in one leg of the L-shaped plate members.

16. A refrigerant distributor according to claim 11, wherein said pair of corrugated plate members are U-shaped plate members.

17. A refrigerant distributor according to claim 16, wherein at least some of said distributor refrigerant conduits are connected to discharge conduits of the heat exchanger and are formed in one leg of the U-shaped plate members, and wherein at least some of said distributor refrigerant conduits are connected to inlet conduits of the heat exchanger and are formed in the other leg of the U-shaped plate members.

18. A refrigerant distributor according to claim 17, wherein an aperture is provided in a connecting base between the two legs of said U-shaped plate members.

19. A refrigerant distributor according to claim 11, wherein at least one of said distributor refrigerant conduits has a bulged section of greater cross-sectional size than adjacent conduit sections.

20. A refrigerant distributor according to claim 19, wherein a flow direction switching member is contained in the bulged section.

21. A refrigerant distributor according to claim 11, wherein said pair of plate members are made of phosphor bronze.

22. An air conditioner system comprising:

a heat exchanger including a plurality of conduits for refrigerant, a fan for supplying air to said heat exchanger, and a refrigerant distributor disposed upstream of said heat exchanger and made by joining a pair of corrugated plate members to form distributor refrigerant conduits along facing preformed corrugation grooves of the plate members for communicating refrigerant to the respective heat exchanger refrigerant conduits, wherein the preformed corrugation grooves include preformed conduit restriction portions which provide for a predetermined refrigerant flow rate in said conduits corresponding to optimum flow through said heat exchanger with respect to flow of air from said fan over said heat exchanger.

23. An air conditioner system according to claim 22, wherein said heat exchanger is an outdoor heat exchanger.

24. An air conditioner system according to claim 22, wherein said heat exchanger is an indoor heat exchanger.

25. An air conditioner system according to claim 23, further comprising:

a plurality of further heat exchangers in the form of respective indoor heat exchangers which are connected with the outdoor heat exchanger, at least one further fan for supplying air to said further heat exchangers, and a plurality of further refrigerant distributors disposed upstream of respective ones of the indoor heat exchangers, each of said further refrigerant distributors being disposed upstream of a respective further heat exchanger and being made by joining a pair of corrugated plate members to form distributor refrigerant conduits along facing preformed corrugation grooves of the plate members for communicating refrigerant to the respective further heat exchanger refrigerant conduits, wherein the preformed corrugation grooves of the further refrigerant distributors include preformed conduit restriction portions which provide for a predetermined refrigerant flow in said conduits corresponding to optimum flow through said further heat exchangers with respect to flow of air from said at least one further fan over said further heat exchangers.

26. An air conditioner system according to claim 22, wherein said pair of corrugated plate members are L-shaped plate members, and wherein the preformed corrugation grooves are formed in one leg of the L-shaped plate members, the other leg of said L-shaped plate members providing a support base for the refrigerant distributor which is attachable to a fixed structure.

27. An air conditioner system according to claim 22, wherein said pair of corrugated plate members are U-shaped plate members.

28. An air conditioner system according to claim 27, wherein at least some of said distributor refrigerant conduits are connected to discharge conduits of the heat exchanger and are formed in one leg of the U-shaped plate members, and wherein at least some of said distributor refrigerant conduits are connected to inlet conduits of the heat exchanger and are formed in the other leg of the U-shaped plate members.

29. An air conditioning system according to claim 28, wherein a mounting aperture is provided in a connecting base between the two legs of said U-shaped plate members.

* * * * *

UNITED STATES PATENT AND TRADEMARK OFFICE

CERTIFICATE OF CORRECTION

PATENT NO. : 5,743,111
DATED : April 28, 1998
INVENTOR(S) : Shunji Sasaki, et al.

It is certified that error appears in the above-identified patent and that said Letters Patent is hereby corrected as shown below:

Column 4, line 9, "B - B" should read --V - V--.

Column 4, line 10, "C - C" should read --VI - VI--.

Column 4, line 17, "F - F" should read --X - X--.

Column 4, line 18, "G - G" should read --XI - XI--.

Signed and Sealed this

Twenty-third Day of February, 1999

*Attest:*

Q. TODD DICKINSON

*Attesting Officer*

*Acting Commissioner of Patents and Trademarks*